US006892479B2

(12) United States Patent
Auger et al.

(10) Patent No.: US 6,892,479 B2
(45) Date of Patent: May 17, 2005

(54) ARTICLE OF CLEATED FOOTWEAR HAVING MEDIAL AND LATERAL SIDES WITH DIFFERING PROPERTIES

(75) Inventors: Perry Auger, Tigard, OR (US); Troy Lindner, Saint Michael, MN (US); Peter A. Hudson, Portland, OR (US)

(73) Assignee: Nike, Inc., Beaverton, OR (US)

( * ) Notice: Subject to any disclaimer, the term of this patent is extended or adjusted under 35 U.S.C. 154(b) by 141 days.

(21) Appl. No.: 10/179,014

(22) Filed: Jun. 26, 2002

(65) Prior Publication Data

US 2004/0000075 A1 Jan. 1, 2004

(51) Int. Cl.[7] ..... A43B 5/02; A43B 5/00; A43C 15/00

(52) U.S. Cl. ..... 36/128; 36/134; 36/67 A; 36/59 R

(58) Field of Search ..... 36/128, 134, 67 R, 36/67 A, 59 C, 59 R; D2/947, 948, 951, 960, 962

(56) References Cited

U.S. PATENT DOCUMENTS

| | | | | |
|---|---|---|---|---|
| 4,315,374 A | | 2/1982 | Sneeringer | |
| 4,316,334 A | | 2/1982 | Hunt | |
| 4,347,674 A | | 9/1982 | George | |
| 4,393,604 A | * | 7/1983 | Crowley | 36/128 |
| 4,454,662 A | | 6/1984 | Stubblefield | |
| 4,914,838 A | | 4/1990 | Ihlenburg | |
| 5,201,126 A | | 4/1993 | Tanel | |
| 5,461,801 A | * | 10/1995 | Anderton | 36/128 |
| 5,940,993 A | * | 8/1999 | Ronci | 36/134 |
| 6,016,613 A | | 1/2000 | Campbell et al. | |
| 6,052,923 A | * | 4/2000 | McMullin | 36/127 |
| 6,108,943 A | | 8/2000 | Hudson et al. | |
| 6,167,641 B1 | * | 1/2001 | McMullin | 36/127 |
| 6,178,667 B1 | | 1/2001 | Kaneko et al. | |
| 6,233,850 B1 | * | 5/2001 | Peabody | 36/134 |
| 6,305,104 B1 | * | 10/2001 | McMullin | 36/127 |

FOREIGN PATENT DOCUMENTS

| | | | |
|---|---|---|---|
| WO | WO 92/18027 | * 10/1992 | A43D/5/00 |

* cited by examiner

*Primary Examiner*—Anthony Stashick
(74) *Attorney, Agent, or Firm*—Banner & Witcoff, Ltd.

(57) ABSTRACT

An article of footwear includes a sole having a different performing lateral and medial regions. Ground engaging members, such as cleats, provide traction and one of the regions, preferably the lateral region, includes a stability member extending from the sole and spanning between a pair of adjacent ground engaging members in a heel to toe direction. The ground engaging members may have a body and a tip portion. Each tip portion may be integrally formed with all or a portion of its respective body. The medial and lateral regions include buttressing member having different characteristics and dimensions for strengthening the ground engaging members with providing enhanced flexibility.

22 Claims, 8 Drawing Sheets

ARTICLE OF CLEATED FOOTWEAR HAVING MEDIAL AND LATERAL SIDES WITH DIFFERING PROPERTIES

FIELD OF THE INVENTION

The present invention generally relates to a cleated article of footwear. More specifically, the invention relates to a cleated article of footwear designed to address motions prevalent in the sport of soccer for enhancing performance and preventing injuries.

BACKGROUND OF THE INVENTION

The modern athletic shoe is a combination of many elements which have specific functions, all of which must work together for the support and protection of the foot during an athletic event. While the design of an athletic shoe has become a refined science, there has been little advancement for cleated footwear.

Cleated athletic shoes, particularly soccer shoes, typically includes a sole having an upper extending upwardly from the sole and into which the foot of the athlete is positioned and secured in place. The sole provides traction, protection, and a durable wear surface. In addition, a plurality of cleats are secured to the sole and extend downwardly from it to provide the traction of the shoe when the athlete runs on a surface ground.

Most cleated athletic shoes, are routinely designed so that the medial side and the lateral side of the shoe do not apparently differ in configuration. Such designs, however, do not take into account the demands and requirements of the sport as they relate to the performance and safety of the athletes. For example, motions prevalent in soccer, such as sides-to-side and foot plating for kicking a ball, create instability in existing cleated shoes leading to fatigue, injury and inefficiency of footwork action.

A conventional cleated athletic shoe usually includes a uniform pattern of cleats in the rearfoot portion and in the forefoot portion of the outsole. While the shape of the cleats may differ from shoe design to shoe design, the shape of the cleats are usually fairly uniform on each shoe. There exist some soccer shoe designs having blade-shaped or blade-like studs or cleats.

Available soccer shoes, however, suffer from a number of disadvantages. Conventional soccer shoes are designed to treat the foot under a uniform or blanket approach to stability or traction control. One disadvantage of these conventional soccer shoes is that such shoes hinder the planting of foot of the athlete on the lateral portion of the sole. This problem results primarily from the relatively high ground impact forces in which the conventional cleats are ill equipped to handle. The high impact forces on lateral portion of the sole can be greater than the relative forces acting on the medial portion of the sole. This significant interaction of forces, in turn may cause several cleats to bend, or collapse in the lateral portion of the sole. The conventional cleats collapsing under the severe loading can cause the foot of the wear to prematurely rollover and may lead to injury of the foot. In addition, the athlete is sometimes left in an awkward position following the planting movement, which can adversely affect the passing and shooting performance of the soccer athlete. Additionally, while conventional soccer shoes can be used for cutting or side-to-side motion, they are ill equipped to enhance the traction for this type of foot movement. Accordingly, an article of footwear for use in the sport of soccer and other similar sports that maximizes performance and minimizes injury was thus needed.

BRIEF SUMMARY OF THE INVENTION

Briefly, the present invention overcomes deficiencies of certain athletic shoes to provide an article of footwear, particularly overcomes deficiencies found in conventional cleated shoes.

Broadly, in one aspect of the invention, an article of footwear includes an upper and a sole including a lateral region and a medial region. The sole includes a plurality of downwardly extending ground engaging members for engaging a ground surface and providing traction. At least one of the regions includes a stability member downwardly extending from the sole and spanning between a pair of adjacent ground engaging members generally in a heel-to-toe direction of said sole.

According to a second aspect of the invention, an article of footwear includes the sole with the lateral region having a lateral buttressing member extending from the sole and from a sidewall of the lateral ground engaging member. The medial region of the sole includes a medial buttressing member being connected to a medial ground engaging member in which the medial buttressing member and the lateral buttressing member are different.

According to a third aspect of the invention, an article of footwear, the lateral region includes a first pair of adjacent ground engaging members being joined by a rib member extending between the first pair of adjacent ground engaging members substantially disposed in a heel-to-toe direction for providing stiffness to said sole. The medial region includes a second pair of adjacent ground engaging members having a separation for providing flexibility in a region to the sole.

The present invention advantageously applies features and structures to the forces applicable to the different areas of the shoe, and provides different designs for the lateral and medial region of the shoe in particularly the sole, in order to enhance flexibility, balance control, propulsion, stability and support in the specific areas where needed. These advantages, in turn, provides improved performance and minimize injuries for the wearer.

These and other aspects, features and advantages of the present invention will be readily apparent and fully understood from the following detailed description of preferred embodiments, taken in connection with the appended drawings, which are included by way of example and not by way of limitation with regard to the claimed invention, in which like reference numerals identifying the elements throughout.

DETAILED DESCRIPTION OF THE PREFERRED EMBODIMENTS

Figure 1:
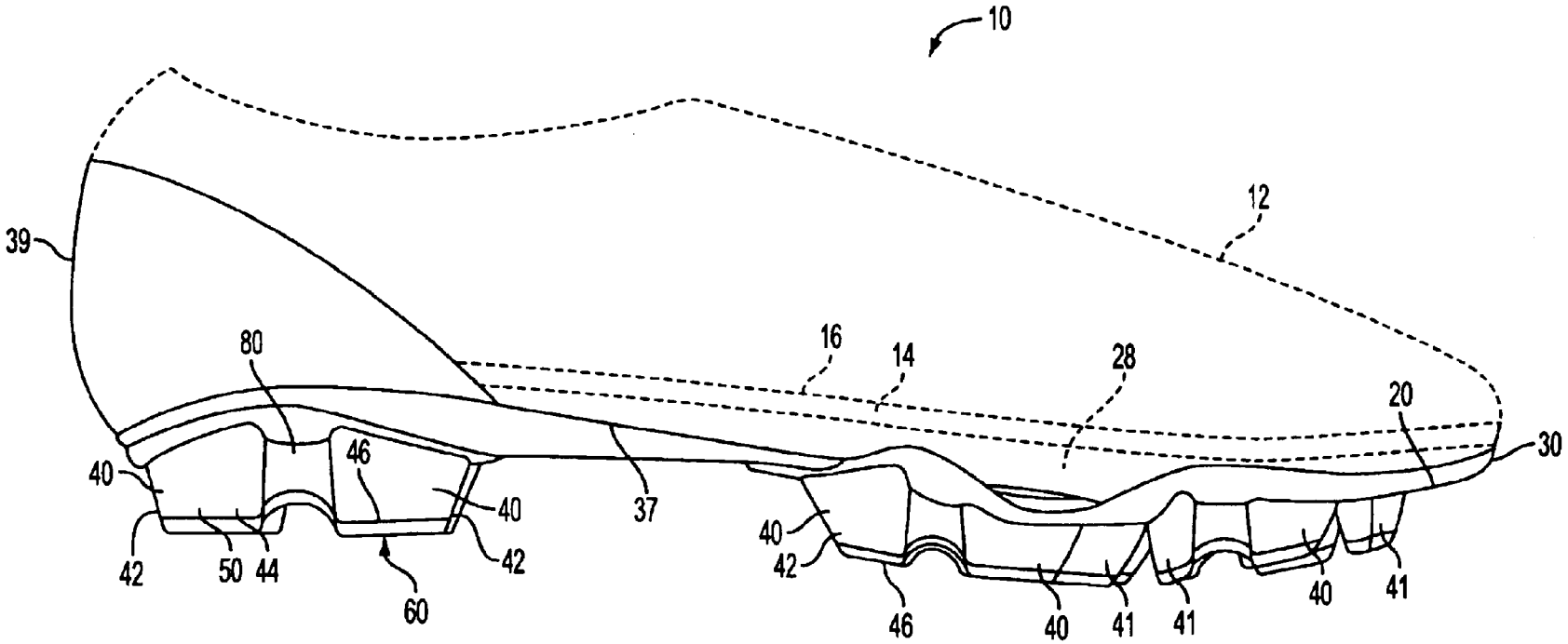
FIG. 1 is a schematic side elevational view of a lateral side of an article of footwear.
Figure 2:
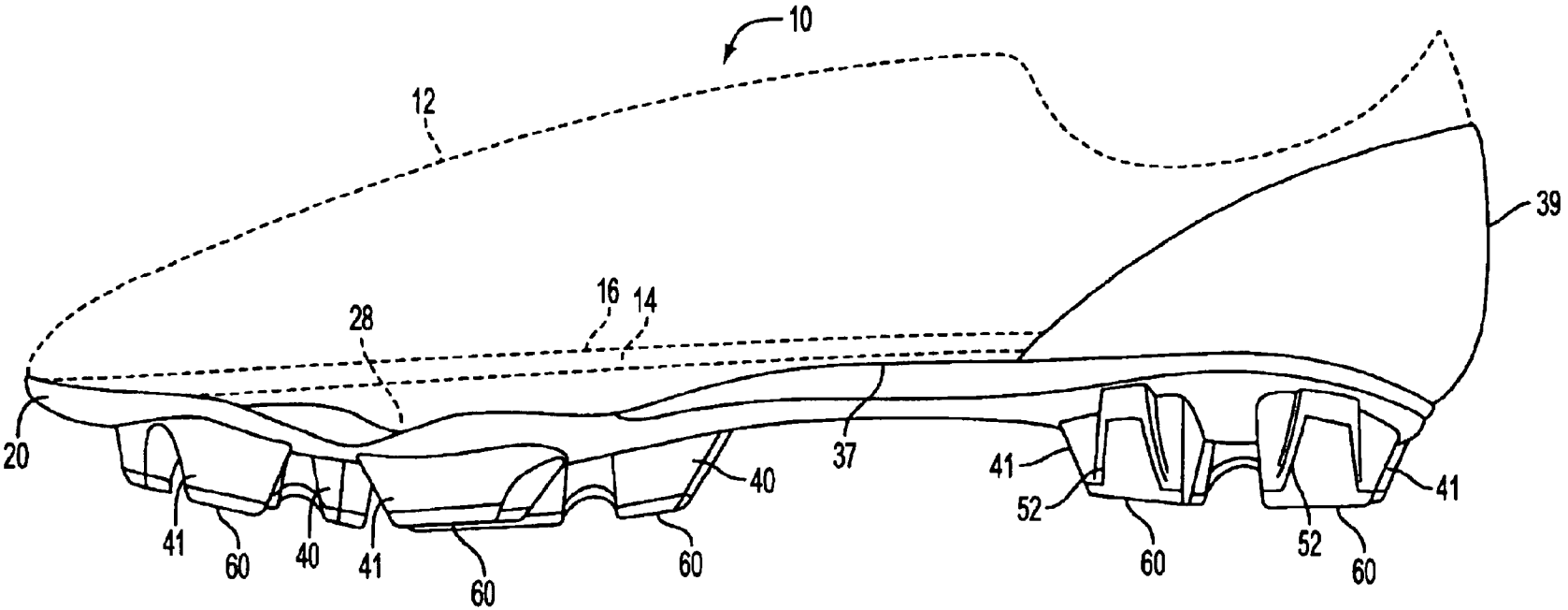
FIG. 2 is a schematic side elevational view of a medial side of the article of footwear shown in FIG. 1.
Figure 3:
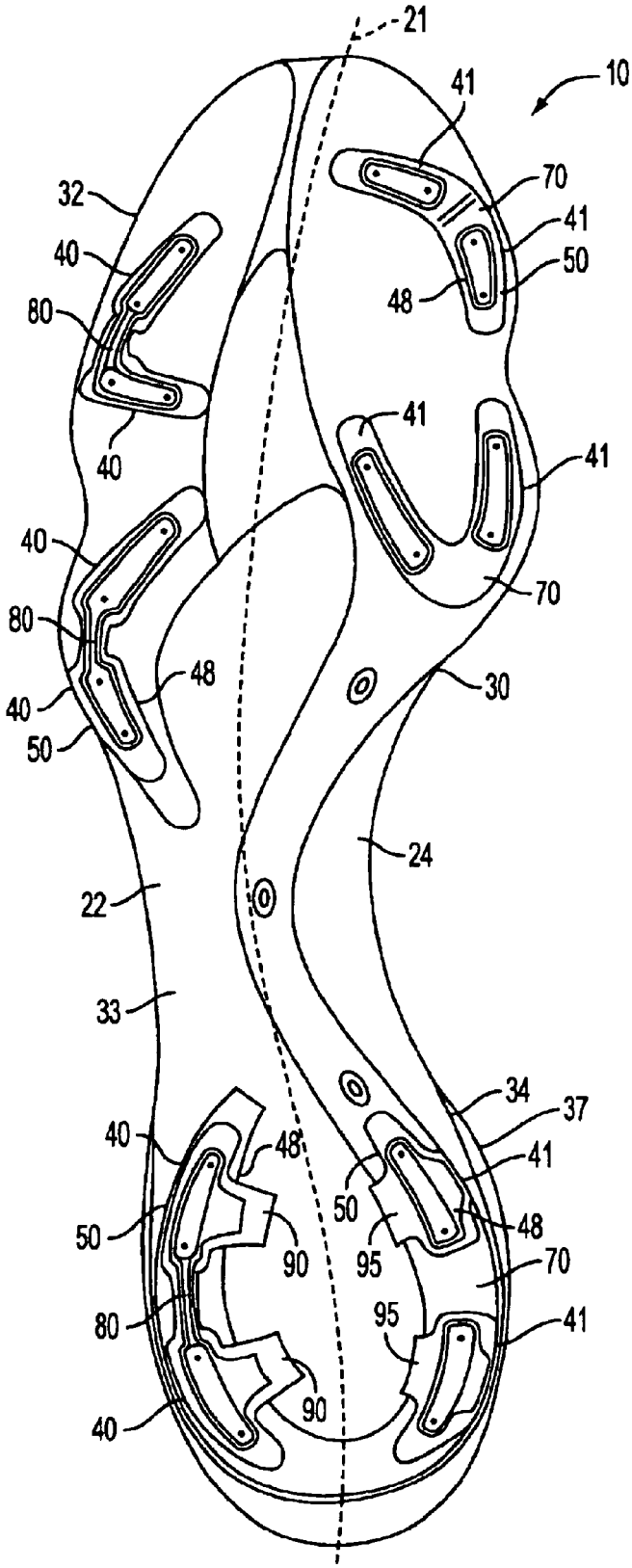
FIG. 3 is a schematic bottom plan view of the article of footwear shown in FIG. 1.

FIGS. 1-7A and 7B illustrate a cleated article of footwear, for example a soccer shoe. The article of footwear is generally referred to herein as a shoe 10. Shoe 10 includes an upper 12 being attached to a sole 20 having a plurality of downwardly extending ground engaging members 40, 41 such as cleats. Shoe 10 advantageously enhances traction control and stability of a foot of a wearer. This is achieved by shoe 10 having a lateral-medial enhancing performance in which sole 20 is made up of two regions: a lateral region 22 and a medial region 24, each region functions differently. As shown in FIG. 3, sole 20 includes a lateral-medial dividing line 21, which is defined as a line generally formed by bisecting the midpoints between the front and rear of the sole 20 separating the two side-by-side regions of the sole. For ease of explanation, when shoe 10 is worn, lateral region 22 is generally oriented on the side facing away from of the centerline of a wearer's body. Likewise, medial region 24 is generally oriented on the side facing towards the centerline of the body.

As shown in FIGS. 1 and 3, lateral region 22 of sole 20 includes a plurality of ground engaging members 40 for providing a high degree of stability to the wearer's foot. The stability provided by lateral region 22 holds and supports the lateral side of the wearer's foot during the high amount of force involving certain activities in use such as the foot-planting of the stationary leg associated with kicking a ball. Referring to FIGS. 2 and 3, medial region 24 of sole 20, has a different type of ground engaging member 41 which provide the wearer with a high degree of flexibility and traction control. The flexibility of medial region 24 enhances traction control and other movements in sports, such as soccer or football. For example, improving traction control is valuable for a soccer or football player when he or she is cutting or moving in a fast side-to-side motion. Accordingly, the ground engaging members 40 in lateral region 22 make the lateral side 22 of the sole 20 less flexible and more stable than the ground engaging members 41 make the medial region 24 of the sole 20.

Referring to FIGS. 1–3, in the illustrated shoe 10, the sole 20 includes an outsole plate 30 that extends along the entire length of the outsole. Outsole plate 30 is defined by a forefoot portion 32, and a rearfoot portion 34. The forefoot portion 32 and rearfoot portion 34 generally corresponds to the respective forefoot and rearfoot of the wearer when shoe 10 is properly sized and worn. If desired, rearfoot portion 34 can be enabled to be stiffer than forefoot portion 32, for example, by additional material. Outsole plate 30 functions to provide a ground engaging component of shoe 10 designed for traction and is typically made of a substantially abrasion resistance material. Outsole plate 30 can be formed by injection molding a plastic resin composite into a desired shape. If desired, the plastic resin composite may be an enhanced resin having a fibrous composition, such as nylon, glass, or graphite fiber. In one arrangement, the fibers can be oriented in a heel-to-toe direction. In another arrangement the fiber may be mixed in the resin. If desired, the resin may be filled approximately 10% to 25% fiber filled. In another arrangement, the fibers may be a chopped type mixed in the resin The arrangements provide a relatively stiff outsole for withstanding abrasion and wear from the movements of the foot against ground surfaces. Nevertheless, outsole plate 30 can be formed by other desirable materials and methods.

Referring to FIG. 3, a majority of ground engaging members 40, 41 are disposed substantially around and/or adjacent to the edge of outsole plate 30. This arrangement advantageously reduces some stud point pressure acting on foot of wearer. Nevertheless, ground engaging members 40, 41 have a traction function similar to cleats. Each ground engaging member includes a body portion 42 projecting downwardly from outsole plate 30 in a substantially perpendicular direction relative to a bottom surface 33 of outsole plate 30. Body portion 42 is preferably molded integrally with the outsole plate, either as part of the same initial mold or as an over-molded process, to provide a strong bond. In another arrangement, body portion 42 may be fastened, adhesively bonded, or otherwise fixed to outsole plate 30 by other desirable methods. In use, when the wearer's shoe 10 strikes a ground surface, body portion 42 of the ground engaging members 40, 41 generally penetrate downwardly into the underlying ground surface, such as grass, soil, or artificial turf.

As can be seen in FIGS. 3–7A and 7B, body portion 42 includes a sidewall 44 that extends downwardly from bottom surface 33 of outsole plate 30 to a distal tip or ground penetrating tip 46 of ground engaging member 40, 41. Sidewall 44 includes an interior portion 48, and an exterior portion 50. As been seen in FIGS. 3 and 6, interior portion 48 generally faces towards lateral-medial dividing line 21 or the interior of outsole plate 30. In contrast, exterior portion 50 generally faces away from lateral-medial dividing line 21. In the illustrated embodiment, for each ground engaging member 40, 41, exterior portion 50 and interior portion 48 are disposed in a substantially parallel arrangement towards each other.

Figure 4A:
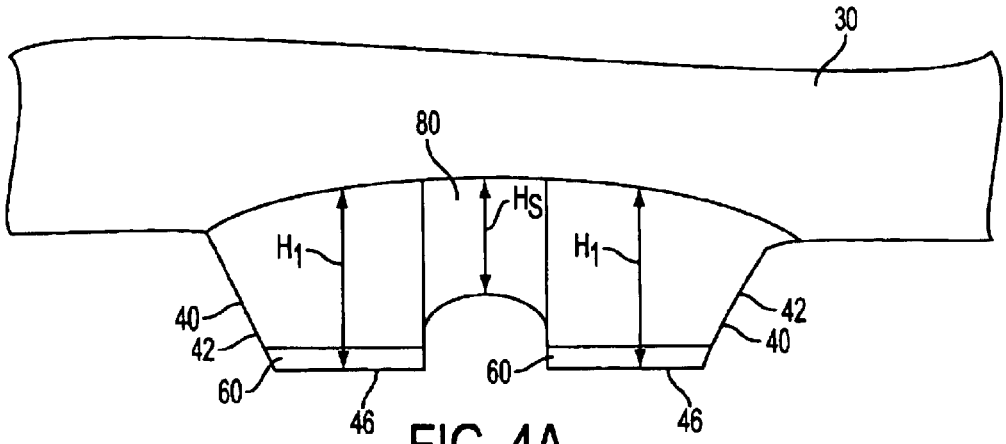
FIGS. 4A and 4B are partial schematic diagrams of alternative embodiments of a ground engaging member disposed on the lateral side of the article of footwear shown in FIG. 1.
Figure 4B:
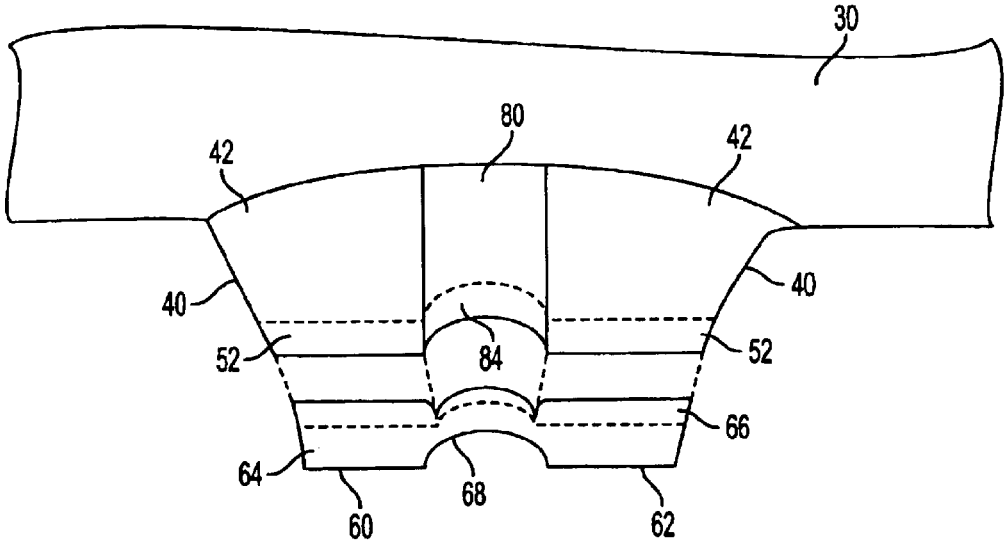
Figure 7A:
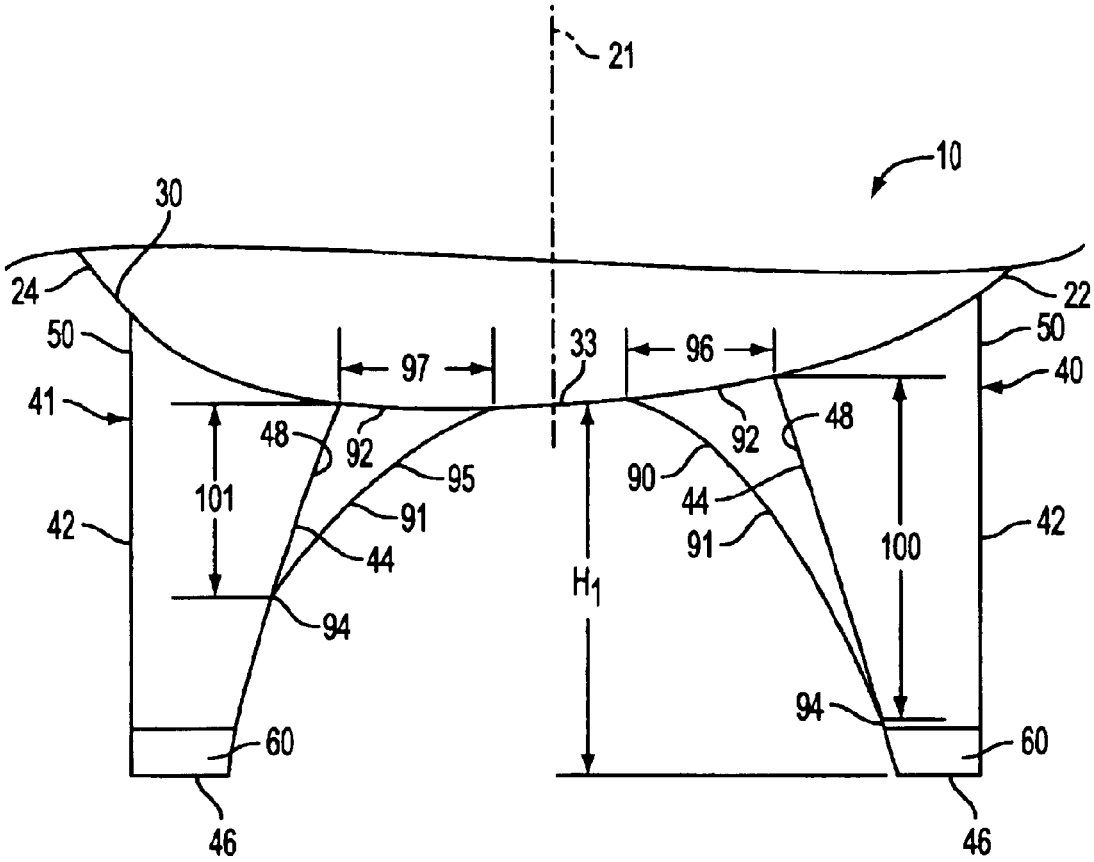
FIGS. 7A and 7B are partial schematic rear elevational views of alternative embodiments of ground engaging members in the rearfoot portion shown of the article of footwear shown in FIG. 1.
Figure 7B:
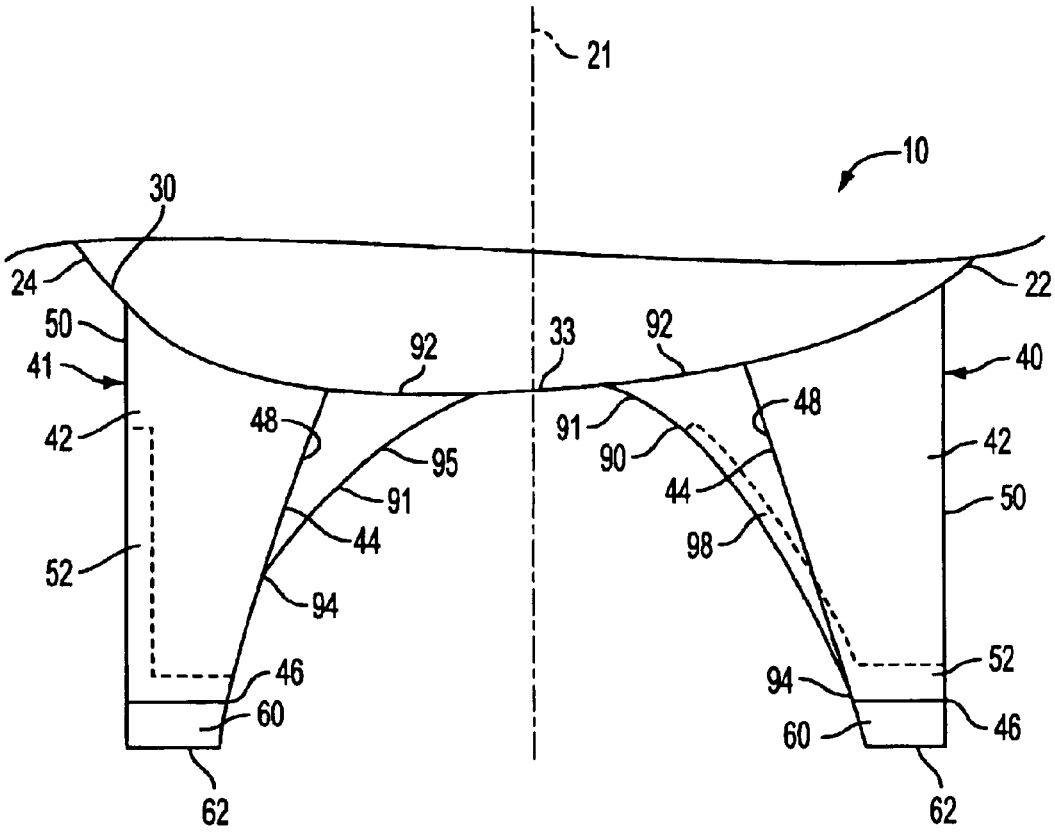

As best seen in FIGS. 4A–B and 7A–B, in an embodiment, each ground engaging member 40, 41 may include a tip member or tip portion 60. In one arrangement, as shown in FIGS. 4A and 7A, tip member 60 can be integrally formed from same material of body portion 42 for ground engaging members 40, 41. In another arrangement as shown in FIGS. 4B and 7B, tip member 60 may be a separable unit that is received and engaged in a distally disposed receiving portion 52 in distal tip 46 of body portion 42. With reference to FIGS. 4B and 7B, tip member 60 is securely held to outsole plate 30 by receiving portion 52. Receiving portion 52 is integrally formed in body portion 42 and is substantially embodied as a receiving slot, channel, depression or cavity in body portion 42. In a further arrangement, receiving portion 52 may be disposed in sidewall 44 of body portion 42. This structure can be seen in FIGS. 2 and 7B, in medial region 24 and rearfoot portion 34 of outsole plate 30 in which receiving portion 52 is disposed within exterior portion 50 of the sidewall 44 such that a cavity or notch is located near bottom surface 33 and extends to distal tip 46 of body portion 42.

With reference to FIG. 4B, tip member 60 includes a ground-penetrating portion 62, an exposed portion 64, and a mating portion 66. Ground penetrating portion 62 is the first portion of tip member 60 that interacts with the ground surface. Exposed portion 64 extends between the ground-penetrating portion 62 and mating portion 66. Mating portion 66 is the portion of tip member 60 that is engaged and retained in receiving portion 52 of body portion 42. Depending on the intended ground surfaces for use, it is desirable to have tip member 60 constructed from a different material than outsole plate 30. Tip member 60 may be composed of a metal, a plastic, and a rubber or composite material. For example, a metal material may include a steel or an alloy. Tip member 60 can be secured to body portion 42 by adhesives or can be replaceable on body portion 42 for different types of ground surfaces.

Figure 5:
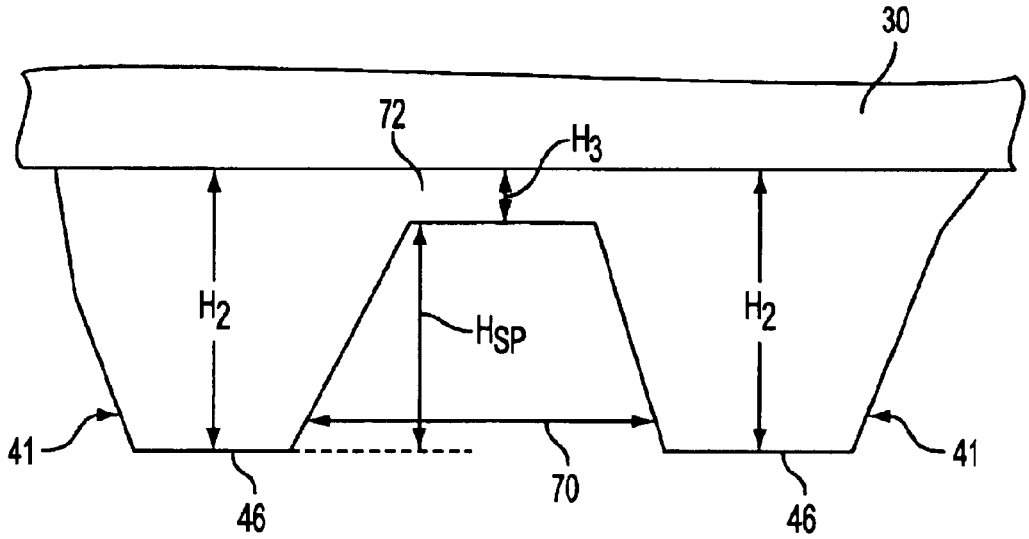
FIG. 5 is a partial schematic diagram of a side elevational view of ground engaging members on the medial side of the article of footwear shown in FIG. 1.
Figure 6:
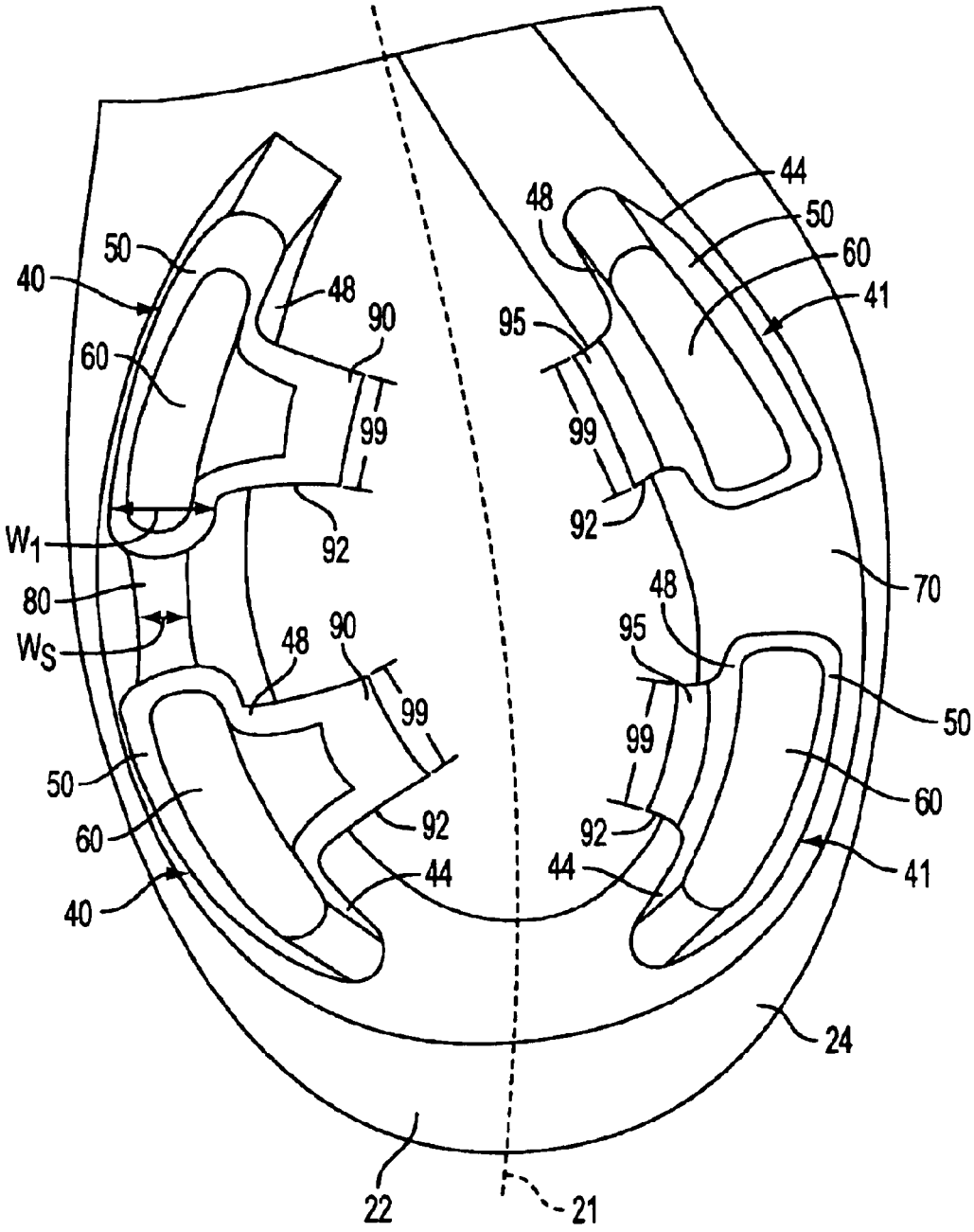
FIG. 6 is an enlarged schematic bottom plan view of a rearfoot portion of the article of footwear shown in FIG. 1.

Turning to FIGS. 2, 3, 5, and 6, the lateral-medial structure of shoe 10 is further illustrated in which ground engaging members 41 in medial region 24 provides the wearer with a high degree of flexibility and traction control during cutting or side to side motion associated with foot movements in the sports such as soccer. As defined herein the term "adjacent pair" or "pair of adjacent" ground engaging members corresponds to the ground engaging members that are next to each other and separated by less than 2.5 cm to 3 cm. As can be seen in FIGS. 5 and 6, ground engaging members 41 are also separated for improved ground penetration performance. This is achieved in medial region 24 between the adjacent pairs of ground engaging members 41 by a gap or separation portion 70. Separation portion 70 enhances the side-to-side cutting motion of the player by penetrating the ground surface for additional traction and enabling flexibility in the sole between the members 41. Additionally, separation portion 70 enables the medial region of outsole plate 30 to bend more relative to the heel-to-toe direction than in the lateral region. This is due, in part, to less stiffness provided in the medial region than the lateral region.

Turning to FIG. 5, separation portion 70 can be characterized by a gap having a distance $H_{sp}$ measured from distal tip 46 to outsole plate 30. The distance $H_{sp}$ may be reduced by a raised portion 72 extending downwardly from the outsole plate. Raised portion 72 also extends between adjacent pairs of ground engaging members 41. In forefoot portion 32 of outsole plate 30, raised portion 72 may have an arcute shape between the sides of the adjacent pairs of ground engaging members 41. With reference to FIG. 5, the height $H_3$ of raised portion 72, as measured from bottom surface 33 of outsole plate 30, can range from 0% to 25%, preferably from 10% to 20% of the height $H_2$ of at least one of the ground engaging members of an adjacent pair of ground engaging members 41 that borders separation portion 70 or, alternatively, an average height of the adjacent pair of members 41.

As seen in FIGS. 3 and 5, separation portion 70 for ground engaging members 41 in rearfoot region 34 is devoid of raised portion 72 or is free of material extending downwardly from outsole plate 30. Therefore, $H_{sp}$ is equaled to the height $H_2$ of at least one ground engaging member 41 of the adjacent pair of members 41. In addition, the height $H_3$ of raised portion 72 is equaled to 0% of the height $H_2$ of any one of ground engaging members 41. In contrast, as seen in FIGS. 2 and 3, adjacent pair of ground engaging members 41 in forefoot region 32, includes raised portion 72 extending downwardly from outsole plate 30. In other words, the space or separation portion 70 between the adjacent pair of ground engaging members 41 is substantially free of material. In one example in the forefoot region 32, separation portion 70 may be characterized by $H_{sp}$ (see FIG. 5) that measures approximately 90% of $H_2$ and the height $H_3$ of raised portion 72 can be approximately 10% of the height $H_2$ of at least one of the ground engaging members of an adjacent pair of ground engaging members 41.

Referring to FIGS. 1, 3, 4A–B, and 6, ground engaging members 40 in lateral region 22 of shoe 10 includes a stability member or rib member 80 designed to provide a high degree of stability to the wearer's foot to facilitate holding and supporting the lateral side of the wearer's foot. Stability member 80 transfers and/or balances forces between the adjacent lateral side ground engaging members 40 and provides additional stability to the wearer's forefoot and rearfoot in lateral region 22. In particular, stability member 80 distributes a substantial portion of the high impact forces involving heel planting movement of the stationary leg associated with passing and kicking a soccer ball or other types of balls. As can be seen in FIGS. 4A and 4B, this support can be achieved by stability member 80 spanning or extending between adjacent pairs of the ground engaging members 40 in lateral region 22 in substantially a heel-to-toe direction. The adjacent pairs are in are close proximity to each other so as create a strong base with stability member 80 and to prevent foot rollover.

Stability member 80 is preferably molded to sidewall 44 of the adjacent pairs of ground engaging members. Referring to FIGS. 3 and 6, stability member 80 is disposed in a relative recessed arrangement between an adjacent pair of ground engaging members with respect to sidewall 44. In one arrangement, stability member can be constructed from the same material as outsole plate 30. In another arrangement, the stability member 80 includes a thin, lightweight, rigid material, such as a carbon fiber or one of a number of plastic resins or a combination thereof in an overmolded arrangement to provide additional stiffness. As can be seen in FIGS. 1, 4A and 4B, the distal end of stability member 80 has a concaved shape, or arched shape so as to not interfere with the traction control for penetrating of ground surfaces.

As best seen in FIG. 4A, stability member 80 has a height $H_s$ dimension that provides improved support but does not hinder ground-penetrating performance of shoe 10. The height $H_s$ of stability member 80, as measured from the outsole plate, may range from 40% to 80% and preferably from 50% to 70% of the height $H_1$ of one or both of its adjacent pair of ground engaging members 40 or, alternatively, an average height of the respective adjacent pair of ground engaging members 40.

Turning to FIG. 6, stability member 80 is disposed at the midpoint of thickness of ground engaging member 40. This thickness or width $W_1$ of ground engaging members 40 may be measured between interior portion 48 and exterior portion 50 of sidewall 44 for any given ground engaging member 40. The width $W_s$ of stability member 80 may range from 40% to 80%, and preferably from 50% to 70% of the thickness measurement of ground engaging member 40. Thus, stability member 80 provides additional stiffness in lateral region 22 than medial region 24 for an improved support base for the stationary leg.

As best seen in FIG. 4B, in another arrangement, the distal end of stability member 80 incorporates a receiving portion 84. This arrangement securely retains tip member 60 in outsole plate 30 in which incremental stiffness can be added to stability member 80. Receiving portion 84 can be integrally connected or formed with the complementary receiving portions 52 of adjacent pairs of ground engaging members 40. Additionally, tip member 60 includes a curved shaped portion 68 that is adapted to mate with the distal end corresponding shape of stability member 80. In the illustrated embodiment, medial region 24 is void of stability member 80. It should be recognized, if desired, stability member 80 can be included with ground engaging members 41 in the medial region. This arrangement will provide support for some wearers who place high forces on medial region 24. The height and corresponding width dimensions of a medially disposed stability member can be different dimensions than a laterally disposed stability member to match the various force profiles acting on the sole in medial region 24.

As illustrated in FIGS. 3, 6, 7A and 7B, shoe 10 includes a plurality of the buttressing members 90 in lateral region 22 and buttressing members 95 in medial region 24 in rearfoot portion 34 of outsole plate 30. Buttressing members 90, 95 may be molded, or integrally formed or otherwise attached with one or more of ground engaging members 40, 41. This arrangement supports rearfoot portion 34 of outsole plate 30 when the lateral region 22 experiences greater magnitude forces than medial region 24. Similarly as stability member 80, the buttressing member 90, 95 can be made from a lightweight, rigid material, such as a carbon fiber or one of a number of plastics or a combination in an over-molded arrangement. Buttressing members 90, 95 extends downwardly from outsole plate 30 in a substantially perpendicular direction and connects to interior portion 48 of sidewall 44 of ground engaging member 40, 41. The arrangement improves conventional cleats by supporting them when they tend to bend, deflect, or deform. This deformation can be in two directions—a direction along a line defined by the heel-to-toe direction or inwardly, in a direction towards lateral-medial dividing line 21. Thus, buttressing members 90, 95 advantageously prevents a large amount of the premature foot rollover and associated collapsing incurred in conventionally cleated footwear.

Referring to FIGS. 7A and 7B, buttressing members 90, 95 has a triangular prismatic shape and may have a slightly concaved interior face 91. Each buttressing members 90, 95 includes a base portion 92 disposed on bottom surface 33 of outsole plate and extends downwardly to a top edge 94 towards distal tip 46 of ground engaging member 40, 41. Buttressing member 90 includes base portion 92 having a width portion 96 extending inward from sidewall 44 of ground engaging member 40 towards lateral-medial dividing line 21. Likewise, buttressing member 95 includes base portion 92 having a width portion 97 extending from the sidewall of ground engaging member 41. As shown in FIG. 6, base portion 92 of buttressing members 90, 95 each include a length portion 99 extending in the heel-to-toe direction.

In one arrangement of shoe 10, greater buttressing support is provided in lateral region 22 than medial region 24. Referring to FIG. 7A, to provide this support, width portion 96 of buttressing member 90 in lateral region 22 is longer than width portion 97 of the buttressing member 95 in medial region 24. Thus, width portion 96 of member 90 in lateral region 22 ranges from 50% to 100%, and preferably from 60% to 80% longer than width portion 97 of buttressing member 95 in medial region 24. Referring to FIG. 6, alternatively, length portion 99 of buttressing member 90 in lateral region 22 can be longer than length portion 99 of buttressing as member in medial region 24. Length portion 99 in lateral region 22 can range from 20% to 60%, and preferably from 30% to 50% longer than length portion 99 of buttressing member 95 in medial region 24. These arrangements advantageously tends to equalize the interaction of the forces impacting outsole plate 30 and the foot of the wearer.

As best seen in FIG. 7A, the distance or height of the buttressing member 90, as measured relative from bottom surface 33 of outsole plate 30 to top edge 94, can range from 40% to 100% of the height of at least one ground engaging member 40, 41. In the illustrated shoe 10, in lateral region 24, the height of top edge 94 is generally 80% to 100% of the height of the ground engaging member 40. In medial region 24, the height of top edge 94 generally ranges from 40% to 80% of the height of ground engaging member 41. As best seen in FIG. 7B, buttressing member 90 in lateral region 22 may also incorporate a receiving portion 98 in interior face 91 so that a portion of tip member 60 can be installed therein. This dual arrangement provides additional support to absorb the impact forces experienced in lateral region 22.

In yet alternative embodiments, the previously described stability member 80 and buttressing member 90 can be included individually or combined with ground engaging member 40 to form a separable unit or units. The separable unit can then be fastened to outsole plate 30 by bonding or mechanical methods. In one arrangement, stability member 80 can be integrally formed with a pair of ground engaging members to thereby form a stability enhanced cleat unit. In another arrangement, buttressing member 90 can be integrally formed with a ground engaging member to thereby form a buttressed enhanced cleat unit. Further, both stability member 80 and buttressing member 90 can be formed with a pair of ground engaging members to form an enhanced cleat unit. These would be useful in manufacturing of shoe 10 or even in a replaceable ground engaging member configuration.

With reference to FIGS. 1–2, if desired, shoe 10 may include an insole or a sockliner 14 disposed inside and is preferably positioned between the foot of the wearer and the sole 20. In addition, the sockliner 14 further comprises an upper surface defining a footbed 16, that is the portion of the shoe 10 that comes in contact with the bottom of the foot of the wearer. Sockliner 14 provides additional cushioning and shock absorption of the shoe 10. If desired, sockliner 14 may be removable and replaceable from shoe 10. Shoe 10 may include a midsole 28 for providing cushioning and support. Midsole 28 is more compressible than outsole plate 30 to achieve its cushioning function. Midsole 28 may be manufactured from conventional materials that provide the cushioning function. If desired, shoe 10 may include a slight concaved or curved portion 37 that extends upward for providing side-to-side support to the foot of the wearer. Optionally, a heel cup 39 may be provided to firmly support the heel of the foot of the wearer.

In operation, the previously described features, individually and/or in any combination, improves stability and traction control of which are important sports needing cleated footwear. Further, the features of the shoe 10 reduce injury. These advantages are also achieved by the differentiation of design in the medial and lateral region of shoe 10 and the synergistic effects of the two regions. While the various features of shoe 10 work together to achieve the advantages previously described, it is recognized that individual features and sub-combinations of these features can be used to obtain some of the aforementioned advantages without the necessity to adopt all of these features.

While the present invention has been described with reference to exemplary embodiments, it will be understood by those of ordinary skill in the art that various changes may be made and equivalents may be substituted for elements thereof without departing from the scope of the invention. In addition, many modifications may be made to adapt a particular situation or material to the teachings of the invention without departing from the scope thereof. For example, the disclosed structures may be used in for footwear in such sports as football, rugby, lacrosse, or other sports. Therefore, it is intended that the invention not be limited to the particular embodiments disclosed, but that the invention will include all embodiments falling within the scope of the appended claims.

What is claimed is:

1. An article of footwear, comprising:

an upper; and a sole fastened to the upper, said sole having a lateral region and a medial region, each said region including a plurality of downwardly extending ground engaging members for engaging a ground surface and providing traction, at least one of said regions including a rigid stability member downwardly extending from the sole and spanning between a pair of adjacent ground engaging members generally in a heel-to-toe direction of said sole;

wherein each ground engaging member further comprises a distally disposed receiving portion enabling mating engagement with a tip portion;

wherein the stability member further comprises a distally disposed cavity extending between said adjacent pair of the ground engaging members connecting to said receiving portion, said cavity enabling mating engagement of said tip portion therein.

2. The article of footwear of claim 1, wherein the at least one of said regions comprises the lateral region.

3. The article of footwear of claim 2, wherein the sole includes an outsole plate, each of said ground engaging members having a distal ground engaging tip and a height measured from said outsole plate to its distal tip, the height of the stability member ranges between 50% to 70% of the height of at least one ground engaging member of said adjacent pair of ground engaging members that it spans between.

4. The article of footwear claim 3, wherein the height of the stability member ranges from 55% to 65% of the height the at least one ground engaging member of said adjacent pair of ground engaging members that it spans between.

5. The article of footwear of claim 2, wherein each ground engaging member of said adjacent pair of ground engaging members includes a sidewall, said sidewall having an interior portion and an exterior portion, at least one ground engaging member of said adjacent pair of ground engaging members having a width being defined between the interior portion and the exterior portion of the sidewall, a width of the stability member ranging from 50% to 60% of the width of the at least one ground engaging member of said adjacent pair of ground engaging members.

6. The article of footwear of claim 5, wherein the width of the stability member ranging from 55% to 58% of the width of the at least one ground engaging member of said adjacent pair of ground engaging members.

7. The article of footwear of claim 1, further comprising at least one buttressing member extending downwardly from the sole and being connected to an interior portion of at least one ground engaging member of said adjacent pair of ground engaging members.

8. An article of footwear, comprising:

an upper; and a sole fastened to the upper, said sole having a lateral region and a medial region, each said region including a plurality of downwardly extending ground engaging members for engaging a ground surface and providing traction, at least one of said regions including a stability member downwardly extending from the sole and spanning between a pair of adjacent ground engaging members generally in a heel-to-toe direction of said sole;

at least one buttressing member extending downwardly from the sole and being connected to an interior portion of at least one ground engaging member of said adjacent pair of ground engaging members;

wherein the at least one ground engaging member of said adjacent pair further comprises a body portion and a tip portion for being engaged therein and said buttressing member having a depression portion for engaging the tip portion therein.

9. The article of footwear of claim 8, wherein said sole includes a molded outsole plate having said ground engaging members extending downwardly and being molded to said outsole plate.

10. An article of footwear, comprising:

an upper; and a sole attached to the upper, said sole having an lateral region and a medial region, a plurality of lateral and medial ground engaging members extending downwardly from the sole for engaging a ground surface and providing traction, said lateral region including a first lateral buttressing member extending downwardly from the sole and from a medially disposed sidewall of a first lateral ground engaging member, said medial region including a first medial buttressing member extending downwardly from said sole and from a laterally disposed sidewall of a first medial ground engaging member, said first medial buttressing member and said first lateral buttressing member having different dimensions.

11. The article of footwear of claim 10, wherein the first medial buttressing member includes greater dimensions than the first lateral buttressing member.

12. The article of footwear of claim 10, wherein the first medial buttressing member and the first lateral buttressing member each have a base portion and extend from said base portion to a distal edge, said distal edge being located in the sidewall of the respective first medial ground engaging member and the first lateral ground engaging member, the base portion of the first lateral buttressing member having a greater length than the base portion of the first medial buttressing member.

13. The article of footwear of claim 12, wherein base portion includes a width being measured from the respective sidewall of the first lateral ground engaging member and the first medial ground engaging member, the width of the first lateral buttressing member in the lateral region ranges from 50% to 100% greater than the width of the first medial buttressing member in the medial region.

14. The article of footwear of claim 12, further comprising an outsole plate, wherein the first lateral buttressing member and first medial buttressing member each including a height being measured from the outsole plate to the distal edge of the first lateral and medial buttressing members, the first lateral buttressing member having a height greater than the height of the first medial buttressing member.

15. The article of footwear of claim 14, wherein the height of the distal edge of the first lateral buttressing member ranges from 50% to 100% greater than of the height of the distal edge of the first medial buttressing member.

16. The article of footwear of claim 10, wherein the first lateral ground engaging member and the first medial ground engaging member each further comprises a receiving portion and a tip portion for being received in the receiving portion.

17. The article of footwear of claim 16, the wherein the first lateral buttressing portion further includes said tip portion.

18. The article of footwear of claim 17, wherein said receiving portion of the first medial ground engaging member further extends in a medially disposed portion of the sidewall.

19. The article of footwear of claim 10, wherein the first lateral buttressing member and the first medial buttressing member are disposed on a rearfoot portion of said sole.

20. An article of footwear, comprising:

an upper; and a sole connected to the upper, said sole having an lateral region and a medial region, a plurality of ground engaging members extending from the sole for engaging a ground surface and providing traction, said lateral region including a first pair of adjacent ground engaging members being joined by a rib member extending between said first pair being substantially disposed in a heel-to-toe direction, said medial region including a second pair of adjacent ground engaging members including a separation portion providing flexibility to said sole in a region between the second pair of adjacent ground engaging members;

wherein each ground engaging member further comprises a distally disposed slot portion for mating engagement with a distal tip portion;

wherein the rib member further comprises a distally disposed cavity portion between said first pair of the ground engaging members connecting to said slot portion therein, said cavity for mating engagement of said distal tip portion therein.

21. The article of footwear of claim 20, further comprising a first buttressing member extending downwardly from the sole being connected an interior sidewall of at least one ground engaging member of said first pair of ground engaging members, and a second buttressing member extending downwardly from said sole being connected an interior sidewall of at least one ground engaging member of said second pair of ground engaging members.

22. The article of footwear of claim 21, wherein said first buttressing member further includes a receiving portion for receiving said distal tip portion therein.

* * * * *